US008953982B2

(12) United States Patent
Tachiki et al.

(10) Patent No.: US 8,953,982 B2
(45) Date of Patent: Feb. 10, 2015

(54) DISPLACEMENT MECHANISM FOR SECONDARY TRANSFER UNIT OF AN IMAGE FORMING APPARATUS

(75) Inventors: Hiroshi Tachiki, Osaka (JP); Hideshi Izumi, Osaka (JP); Toshiki Takiguchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/009,876

(22) PCT Filed: Apr. 5, 2012

(86) PCT No.: PCT/JP2012/059322

§ 371 (c)(1),
(2), (4) Date: Oct. 4, 2013

(87) PCT Pub. No.: WO2012/141062

PCT Pub. Date: Oct. 18, 2012

(65) Prior Publication Data

US 2014/0016965 A1 Jan. 16, 2014

(30) Foreign Application Priority Data

Apr. 11, 2011 (JP) ..... 2011-086888

(51) Int. Cl.
*G03G 15/08* (2006.01)
*G03G 15/16* (2006.01)
*G03G 15/01* (2006.01)

(52) U.S. Cl.
CPC ..... *G03G 15/16* (2013.01); *G03G 15/0189* (2013.01); *G03G 15/167* (2013.01); *G03G 2215/0132* (2013.01); *G03G 2215/0193* (2013.01)
USPC ..... 399/121

(58) Field of Classification Search
USPC ..... 399/121, 308, 312, 316, 317
See application file for complete search history.

(56) References Cited

U.S. PATENT DOCUMENTS

2007/0217801 A1 9/2007 Tsuboi et al.
2010/0158553 A1* 6/2010 Ueno ..... 399/67

FOREIGN PATENT DOCUMENTS

JP 2002-156844 A 5/2002
JP 2007-248839 A 9/2007

(Continued)

OTHER PUBLICATIONS

International Search Report for corresponding International Application No. PCT/JP2012/059322 mailed May 15, 2012.

*Primary Examiner* — Billy Lactaoen
(74) *Attorney, Agent, or Firm* — Renner, Otto, Boisselle & Sklar, LLP

(57) ABSTRACT

A displacement mechanism for a secondary transfer unit (40) includes a first eccentric cam (71), a second eccentric cam (72) and a shaft member (73). The first eccentric cam (71) and the second eccentric cam (72) are in contact with either edge portion of the secondary transfer unit (40) in width direction of a primary transfer belt (31), and rotate in phase with each other. The shaft member (73) supports the first eccentric cam (71) and the second eccentric cam (72). The first eccentric cam (71) is configured in such a manner that any radius in a peripheral portion (711) is of magnitude not less than a radius at a segment of the second eccentric cam (72) that is in phase with a segment of the peripheral portion (711). The second eccentric cam (72) is configured in such a manner that any radius in at least a segment of a peripheral portion (721) not including a press generating section (722) nor a separation generating section (723) is smaller than a radius at a segment of the first eccentric cam (71) that is in phase with the segment of the peripheral portion (721).

7 Claims, 7 Drawing Sheets

(56) References Cited

FOREIGN PATENT DOCUMENTS

| | | | |
|---|---|---|---|
| JP | 2007-309954 | A | 11/2007 |
| JP | 2010-112970 | A | 5/2010 |
| JP | 2010-175840 | A | 8/2010 |

* cited by examiner

DISPLACEMENT MECHANISM FOR SECONDARY TRANSFER UNIT OF AN IMAGE FORMING APPARATUS

TECHNICAL FIELD

The present invention relates to a displacement mechanism for a secondary transfer unit transferring a developer image borne by a primary transfer belt onto a paper sheet.

BACKGROUND ART

In recent years, image forming apparatus adopting the electrophotography system have been known that includes a primary transfer belt bearing and conveying a developer image having been formed on a plurality of image bearing members and a secondary transfer unit transferring the developer image borne by the primary transfer belt onto a paper sheet in a state of being in contact with pressure with the primary transfer belt. The secondary transfer unit is configured in such a manner as to be capable of being freely displaced between a pressing position and a separate position in relation to the primary transfer belt. Among such image forming apparatus is one using a pair of eccentric cams as a displacement mechanism for the secondary transfer unit that are in contact with either edge portion of the secondary transfer unit in width direction of the primary transfer belt.

Rotatory torque of the eccentric cam varies a great deal depending on its rotational angle. In conventional image forming apparatus, because a pair of eccentric cams of a shape identical to each other has been used, the relationship between the rotatory torque and the rotational angle has been the same within the pair of eccentric cams. This has caused the pair of eccentric cams to have the same rotational angle at which their rotatory torques become greatest, thereby a high-level load occurs in their drive system members including gears, an electromagnetic clutch, a shaft member supporting them and the like when the pair of eccentric cams rotates. Therefore, there have been problems that the electromagnetic clutch is prone to slip, that the shaft member is prone to damage, and that the gears are prone to tooth abrasion and damage.

Then, a displacement mechanism for the secondary transfer unit has been proposed that is configured in such a manner that only a first eccentric cam of the pair of cams is in contact with a rotating member which is a follower at a separation start position and at a maximum torque position, and that only a second eccentric cam is in contact with the rotating member at a contact-with-pressure start position (for example, refer to Patent Literature 1).

CITATION LIST

Patent Literature

[Patent Literature 1]
Japanese Patent Unexamined Publication No. 2007-309954 bulletin

SUMMARY OF INVENTION

Technical Problem

However, with the displacement mechanism for the secondary transfer unit as described in Patent Literature 1, when it is postulated that the eccentric cam is divided into a domain on the right and a domain on the left by a line connecting a point at which the radius of the eccentric cam becomes maximum with a point at which it becomes minimum, the domain on the right is larger in the first eccentric cam whereas the domain on the left is larger in the second eccentric cam; therefore, there has been a risk that distinguishing between the first eccentric cam and the second eccentric cam becomes difficult by visual observation when one cam is turned the other way around. As a result, mistakes in assembly task such as wrong attaching positions between the pair of eccentric cams or the like have been prone to occur. To get rid of mistakes in the assembly task, it has been necessary to perform additional tasks such as dimensional measurement or the like for every eccentric cam, so that workability in the assembly task has been bad.

The present invention is directed to providing a displacement mechanism for a secondary transfer unit capable of reducing the loads working on the drive system members, as well as improving the workability in the assembly task.

Solution to Problem

A displacement mechanism for a secondary transfer unit according to the present invention causes the secondary transfer unit that transfers a developer image onto a paper sheet in a state of being in contact with pressure with a primary transfer belt bearing a developer image to be displaced between a pressing position and a separate position in relation to the primary transfer belt. The displacement mechanism for the secondary transfer unit includes a first eccentric cam, a second eccentric cam, a shaft member and a driving source. The first eccentric cam and the second eccentric cam are in contact with either edge portion of the secondary transfer unit in width direction of the primary transfer belt, and cause the secondary transfer unit to be displaced between the pressing position and the separate position by rotating. The shaft member is rotatably supported by a main body frame of an image forming apparatus provided with the secondary transfer unit, thereby supporting the first eccentric cam and the second eccentric cam fixedly. The driving source rotates the shaft member. The first eccentric cam is configured in such a manner that it has, in a first peripheral portion, a first press generating section for causing the secondary transfer unit to be disposed at the pressing position and a first separation generating section for causing the secondary transfer unit to be disposed at the separate position, and that any radius in the entire first peripheral portion is of magnitude not less than a radius at a segment of the second eccentric cam that is in phase with a segment of the first peripheral portion. The second eccentric cam is configured in such a manner that it has, in a second peripheral portion, a second press generating section of which radius is a same as that of the first press generating section and a second separation generating section of which radius is a same as that of the first separation generating section, and that any radius in at least a segment of the second peripheral portion not including the second press generating section nor the second separation generating section is smaller than a radius at a segment of the first eccentric cam that is in phase with the segment of the second peripheral portion.

In this configuration, the first eccentric cam and the second eccentric cam rotate in phase with each other with the shaft member being rotated by the driving source. At the pressing position, the secondary transfer unit is pressed against the primary transfer belt by both the first eccentric cam and the second eccentric cams. When the first peripheral portion of the first eccentric cam is compared with the second peripheral portion of the second eccentric cam with regard to segments respectively in phase with each other, it follows that there is no segment that is smaller in radius in the entire first peripheral portion of the first eccentric cam than the second peripheral portion of the second eccentric cam, and that at least a segment of the second peripheral portion of the second eccentric cam is smaller in radius than the first eccentric cam. In this manner, because the first peripheral portion of the first eccentric cam and the second peripheral portion of the second eccentric cam are different from each other in shape, a load working on the second eccentric cam is reduced, thereby loads working on drive system members such as gears, an electromagnetic clutch, a shaft member and the like are reduced when the first eccentric cam and the second eccentric cam rotate. Also, because of their distinct difference in shape between each other even when either one is turned the other way around, the first eccentric cam and the second eccentric cam is easily distinguishable by visual observation. Therefore, it is not likely that wrong attaching positions occur between the first eccentric cam and the second eccentric cam.

Advantageous Effects of Invention

The present invention makes it possible to reduce the loads working on the drive system members and to improve workability in the assembly task.

DESCRIPTION OF EMBODIMENTS

A mode of implementation of the present invention is explained below based on the drawings.

Figure 1:
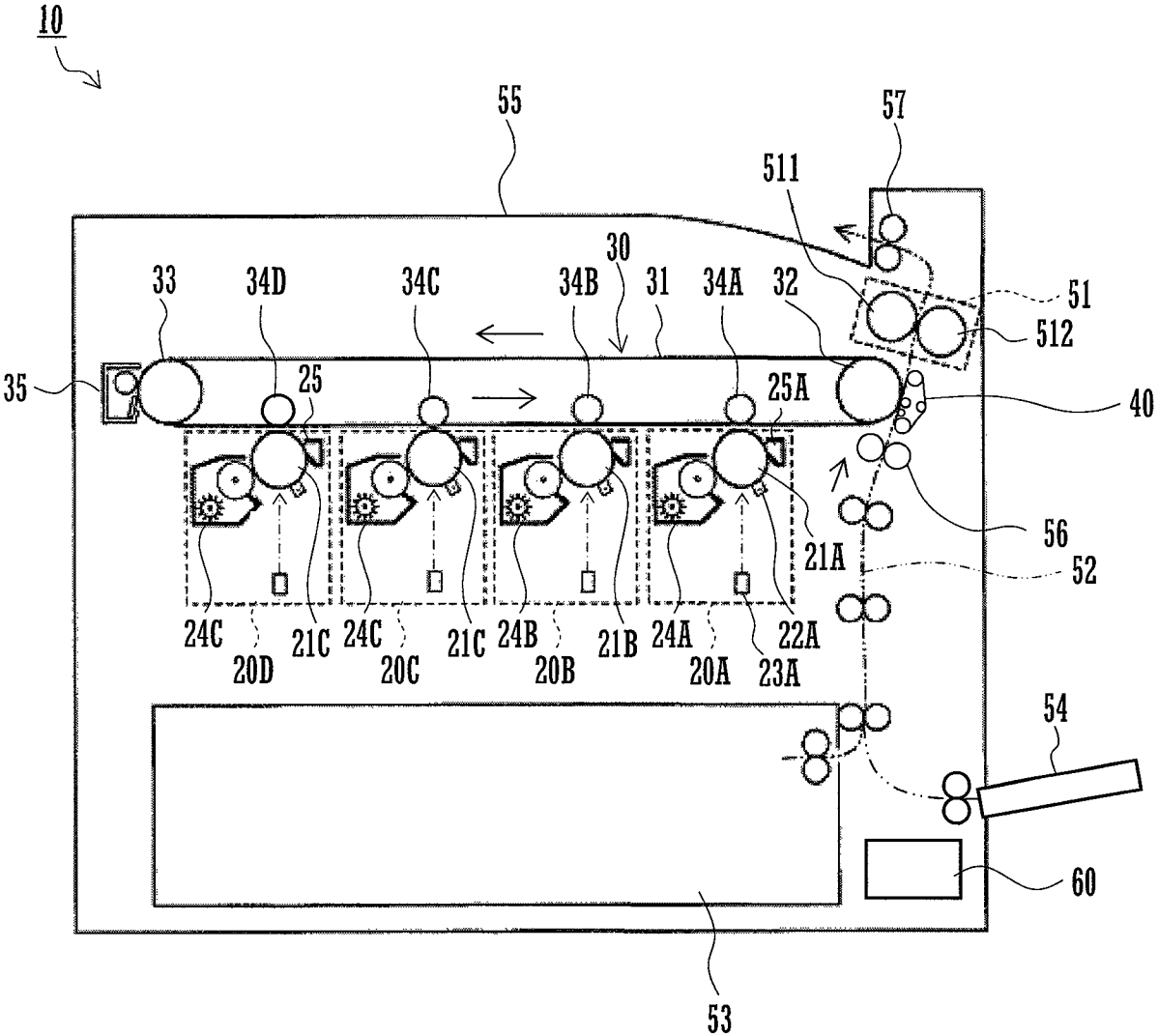
FIG. 1 is a front view showing a general configuration of an image forming apparatus provided with a displacement mechanism for a secondary transfer unit according to an embodiment of the present invention.

As shown in FIG. 1, an image forming apparatus 10 operates in either a monochromatic image forming mode or a full-color image forming mode, and forms a monochrome or a polychrome image onto a paper sheet based on image data. For the paper, a sheet recording medium such as normal paper, thick paper, photographic paper, OHP film and so forth can be exemplified.

The image forming apparatus 10 includes a plurality of image forming sections 20A, 20B, 20C, 20D, a primary transfer unit 30, a secondary transfer unit 40, a fuser unit 51, a paper sheet conveying path 52, a paper feed cassette 53, a hand-fed paper tray 54, a paper receiving tray 55 and a control section 60. The control section 60 generally controls each section of the image forming apparatus 10.

The image forming apparatus 10 performs an image forming process in accordance with the electrophotography method using the image data that correspond to respective hues of the four colors consisting of black, as well as cyan, magenta and yellow which are the three primary colors of the subtractive color mixture obtained from the color separation of a color image. At the image forming sections 20A through 20D, toner images (developer images) of the respective hues are formed. The image forming sections 20A through 20D are aligned along the primary transfer unit 30 in a horizontal direction.

In the following, the image forming section 20A is explained principally. The image forming sections 20B through 20D are configured substantially in the same manner as the image forming section 20A. The image forming section 20A for black includes a photoreceptor drum 21A, an electrostatic charger 22A, an exposure device 23A, a developing device 24A and a cleaning unit 25A, and forms a black toner image through an image forming process according to the electrophotography method.

The photoreceptor drum 21A together with the photoreceptor drums 21B, 21C, 21D respectively included in the image forming sections 20B through 20D are caused to rotate in one direction by a driving force transmitted from a driving motor which is not illustrated. The photoreceptor drum 21A is an image bearing member for monochrome, and the photoreceptor drums 21B through 21D are image bearing members for colors.

The electrostatic charger 22A is disposed in such a manner as to face a circumferential surface of the photoreceptor drum 21A, and charges the circumferential surface of the photoreceptor drum 21A to a predetermined electrostatic potential.

The exposure device 23A projects a laser beam modulated by the image data for black onto the circumferential surface of the photoreceptor drum 21A. This results in the formation of an electrostatic latent image based on the image data for black on the circumferential surface of the photoreceptor drum 21A.

The developing device 24A contains a black toner developer). The developing device 24A develops the electrostatic latent image into a toner image by supplying the toner onto the circumferential surface of the photoreceptor drum 21A.

Similarly, the developing devices 24B through 24D of the image forming sections 20B through 20D respectively contain a toner of each color of cyan, magenta and yellow, and on the photoreceptor drums 21B through 21D of the image forming sections 20B through 20D a toner image of each hue of cyan, magenta and yellow are formed respectively.

The primary transfer unit 30 includes a primary transfer belt 31, a primary transfer drive roller 32, a primary transfer idle roller 33, primary transfer rollers 34A through 34D, and a cleaning unit 35 for the primary transfer belt.

The primary transfer belt 31, which is an endless belt, is passed over the primary transfer drive roller 32 and the primary transfer idle roller 33 and tensioned therewith, and is moved around in a predetermined direction. A peripheral surface of the primary transfer belt 31 faces the respective photoreceptor drums 21A through 21D of the image forming sections 20A through 20D.

The primary transfer rollers 34A through 34D are disposed in such a manner as to face the photoreceptor drums 21A through 21D across the primary transfer belt 31 respectively. A domain where the peripheral surface of the primary transfer belt 31 and the photoreceptor drums 21A through 21D face each other is a primary transfer domain.

To the primary transfer rollers 34A through 34D, a primary transfer bias of a polarity (for example, plus) reverse to an electrostatic charge polarity (for example, minus) of the toner is applied with a constant voltage control. This causes the toner images of respective hues formed on the respective circumferential surfaces of the photoreceptor drums 21A through 21D to undergo primary transfers sequentially in such a manner as to be superimposed onto the peripheral surface of the intermediate transfer belt 31, thereby forming a full-color toner image on the peripheral surface of the intermediate transfer belt 31.

However, when image data on only part of the hues consisting of black, cyan, magenta and yellow are inputted, electrostatic latent image(s) and toner image(s) are formed only at part of the drums corresponding to the part of the hues of the inputted image data among the four photoreceptor drums 21A through 21D. For example, in the monochromatic image forming mode, an electrostatic latent image and a toner image are formed only on the photoreceptor drum 21A corresponding to the black hue, so that only the black toner image is transferred onto the peripheral surface of the primary transfer belt 31.

The cleaning unit 25A collects the toner remaining on the circumferential surface of the photoreceptor drum 21A after the development and the primary transfer.

The secondary transfer unit 40 is configured in such a manner as to be capable of coming into contact with and getting away from the primary transfer drive roller 32 across the primary transfer belt 31. A domain where the primary transfer belt 31 and the secondary transfer unit 40 come into contact with one another with pressure is a secondary transfer domain.

The photoreceptor drums 21A through 21D are arranged, from a side near the secondary transfer domain, in order of the photoreceptor drum 21A for black, the photoreceptor drum 21B for cyan, the photoreceptor drum 21C for magenta, and the photoreceptor drum 21D of yellow. The toner image borne on the peripheral surface of the primary transfer belt 31 is conveyed to the secondary transfer domain by the movement of the primary transfer belt 31.

The paper feed cassette 53 receives the paper sheets. On the hand-fed paper tray 54 are placed paper sheets of indeterminate form or thick paper sheets. The paper sheet conveying path 52 is configured in such a manner as to lead a paper sheet that is fed from the paper feed cassette 53 or the hand-fed paper tray 54 to the paper receiving tray 55 through the secondary transfer domain and the fuser unit 51.

In the neighborhood of the secondary transfer domain on an upstream side in the paper sheet conveyance direction, a paper stop roller 56 is disposed. The paper sheet that is fed from the paper feed cassette 53 or the hand-fed paper tray 54 to the paper sheet conveying path 52 is supplied to the secondary transfer domain by the paper stop roller 56 with a predetermined timing. With the paper sheet being supplied to the secondary transfer domain, close adhesion occurs between the paper sheet and the primary transfer belt 31.

With a predetermined secondary transfer electric field being formed in the secondary transfer domain, the toner image borne on the primary transfer belt 31 undergoes a secondary transfer onto the paper sheet.

Among the toner borne on the primary transfer belt 31, part of the toner remaining on the primary transfer belt 31 without being transferred onto the paper sheet is collected by the cleaning unit 35 for the primary transfer belt. This prevents color mixture from occurring in the next step.

The fuser unit 51 includes a heating roller 511 and a pressing roller 512. The heating roller 511 and the pressing roller 512 are in contact with pressure with each other. The fuser unit 51 heats and presses the paper sheet by conveying the paper sheet with the paper sheet being caught by a nip portion of the heating roller 511 and the pressing roller 512, thereby fixing the toner image durably on the paper sheet. The paper sheet on which the toner image is fixed is discharged onto the paper receiving tray 55 by a pair of paper discharge rollers 57.

Figure 2:
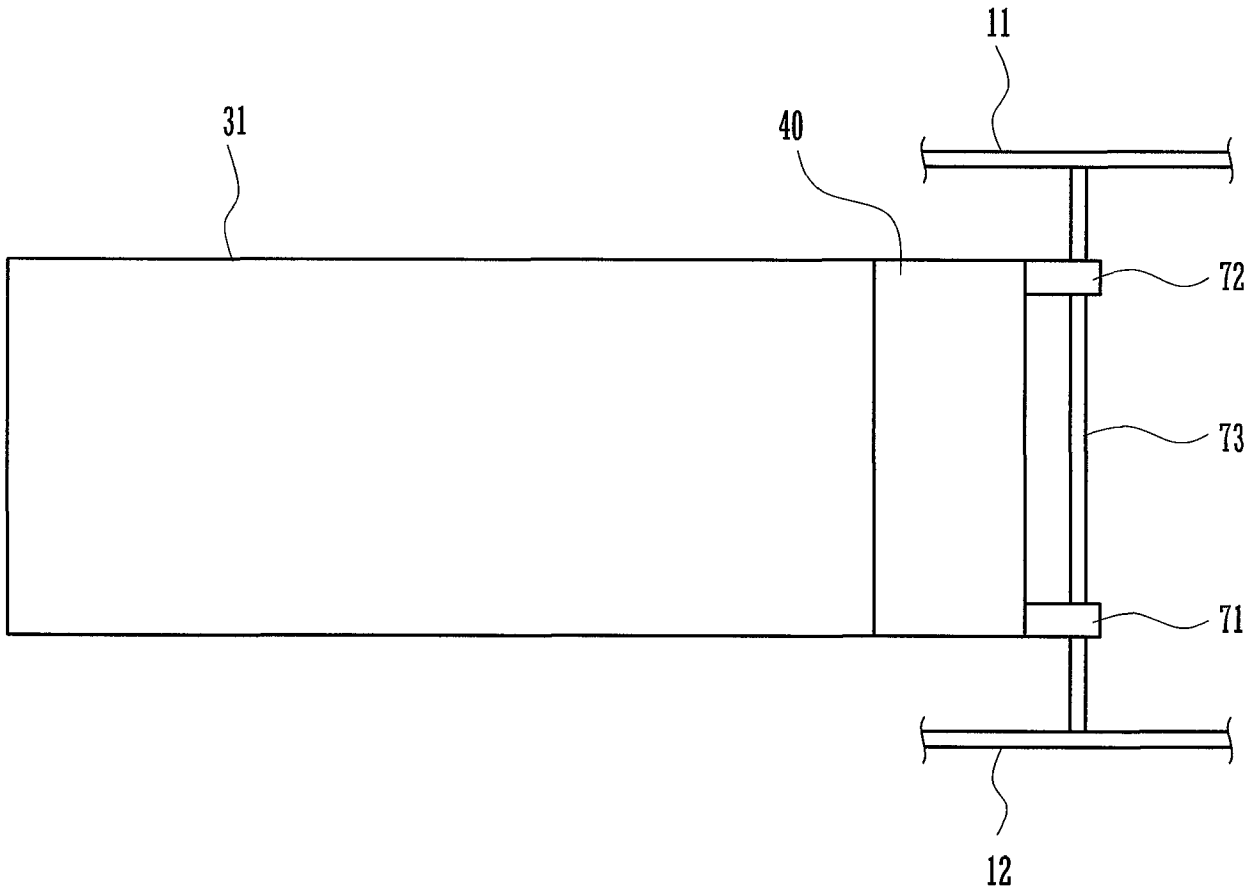
FIG. 2 is a top view typically showing a part of the image forming apparatus.

As shown in FIG. 2, in the top view, a first eccentric cam 71 and a second eccentric cam 72 are disposed on the opposite side of the primary transfer belt 31 in relation to the secondary transfer unit 40. The first eccentric cam 71 and the second eccentric cam 72 are in contact with either edge portion of the secondary transfer unit 40 in width direction of the primary transfer belt 31. The first eccentric cam 71 and the second eccentric cam 72 are supported fixedly by the shaft member 73, and rotate with the shaft member 73. Therefore, the first eccentric cam 71 and the second eccentric cam 72 rotate in phase with each other. The shaft member 73 is rotatably supported by the main body frame 11, 12 of the image forming apparatus 10.

Figure 3:
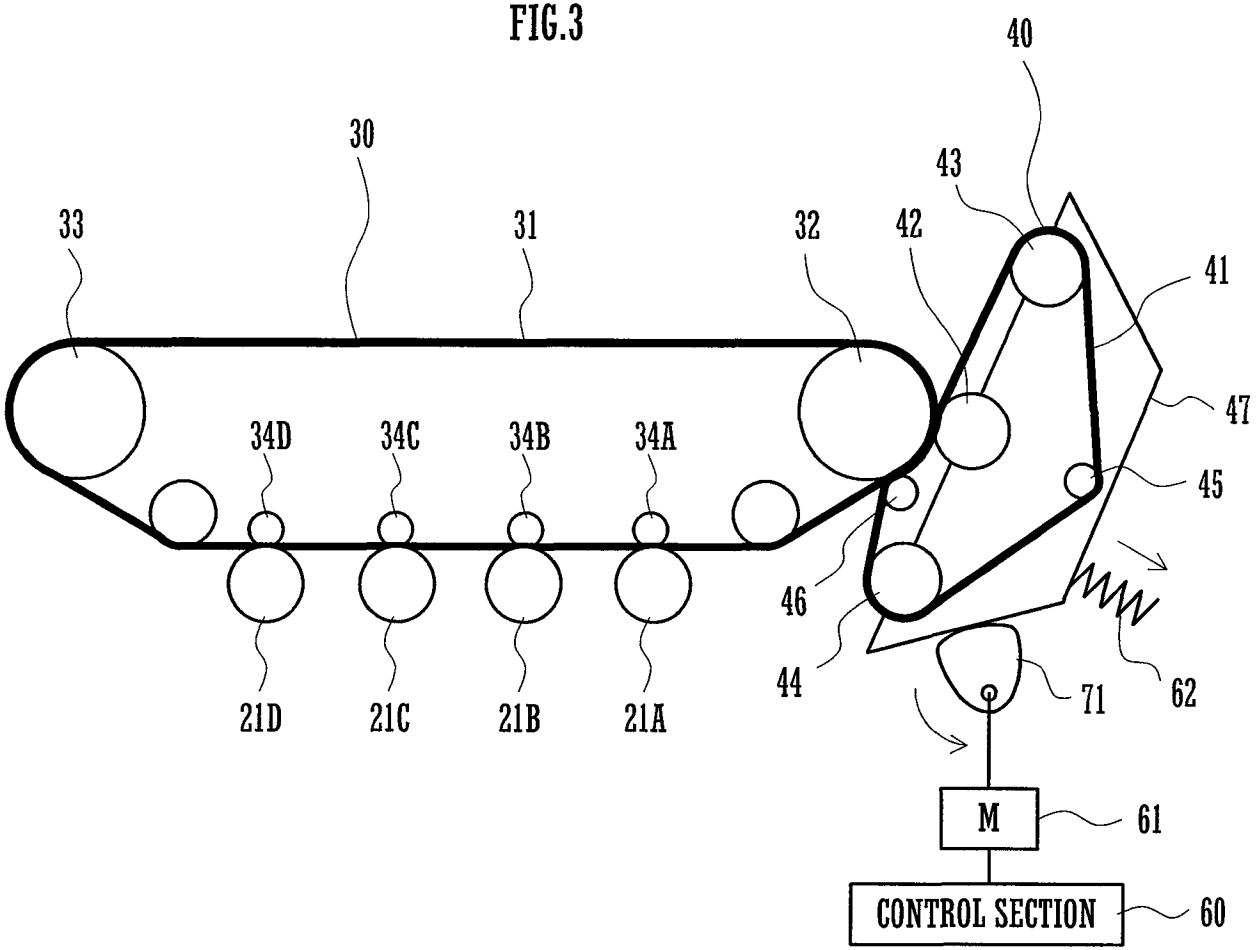
FIG. 3 is a drawing showing a state in which the secondary transfer unit is disposed at a pressing position.

As shown in FIG. 3, the secondary transfer unit 40 includes a secondary transfer belt 41, a secondary transfer roller 42, a secondary transfer drive roller 43, a secondary transfer idle roller 44, a secondary transfer tension roller 45, a back-up roller 46 and a secondary transfer frame 47.

The secondary transfer roller 42, the secondary transfer drive roller 43, the secondary transfer idle roller 44, the secondary transfer tension roller 45 and the back-up roller 46 are supported at shafts thereof by the secondary transfer frame 47. The secondary transfer belt 41 is passed over the secondary transfer roller 42, the secondary transfer drive roller 43, the secondary transfer idle roller 44, the secondary transfer tension roller 45 and the back-up roller 46, being tensioned therewith. The secondary transfer roller 42 is opposed to the primary transfer drive roller 32 across the secondary transfer belt 41 and the primary transfer belt 31.

To the secondary transfer frame 47 is hooked one end of a spring 62, and the other end of the spring 62 is hooked to a predetermined position of the main body frame 11, 12. The spring 62 is one example of an elastic member; and it is a coiled spring, for example. By the spring 62, the secondary transfer frame 47 is urged toward a direction of its getting away from the primary transfer belt 31, that is to say, toward a direction of its coming into contact with pressure with respective peripheral portions of the first eccentric cam 71 and the second eccentric cam 72. As an example, the respective peripheral portions of the first eccentric cam 71 and the second eccentric cam 72 are in contact with pressure with a flat surface portion of the secondary transfer frame 47.

The shaft member 73 rotates toward a predetermined direction with a turning force transmitted from a motor 61. With the shaft member 73 rotating, the first eccentric cam 71 and the second eccentric cam 72 also rotate. The rotation of the motor 61 is controlled by the control section 60. The motor 61 is one example of a driving source.

Figure 4:
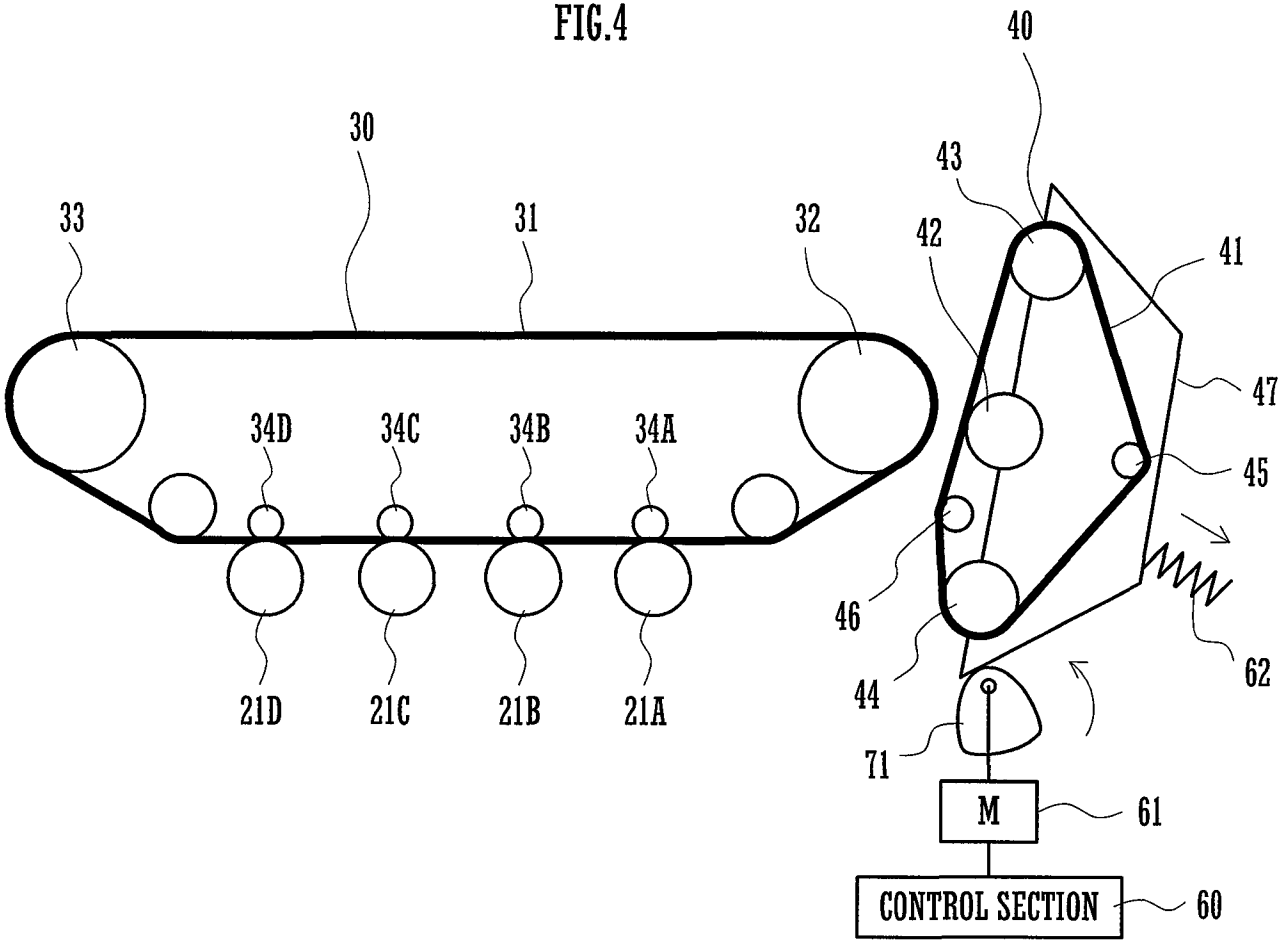
FIG. 4 is a drawing showing a state in which the secondary transfer unit is disposed at a separate position.

With the first eccentric cam 71 and the second eccentric cam 72 rotating, the secondary transfer unit 40 is displaced between a pressing position where it is in contact with pressure with the primary transfer belt 31 as shown in FIG. 3 and a separate position where it is away from the primary transfer belt 31 as shown in FIG. 4. The control section 60, upon causing the secondary transfer unit 4 to be displaced from the separate position to the pressing position with a predetermined timing, once halts the first eccentric cam 71 and the second eccentric cam 72 with the secondary transfer unit 40 disposed at the pressing position, and then causes the secondary transfer unit 40 to be displaced from the pressing position to the separate position with a predetermined timing.

Figure 5A:
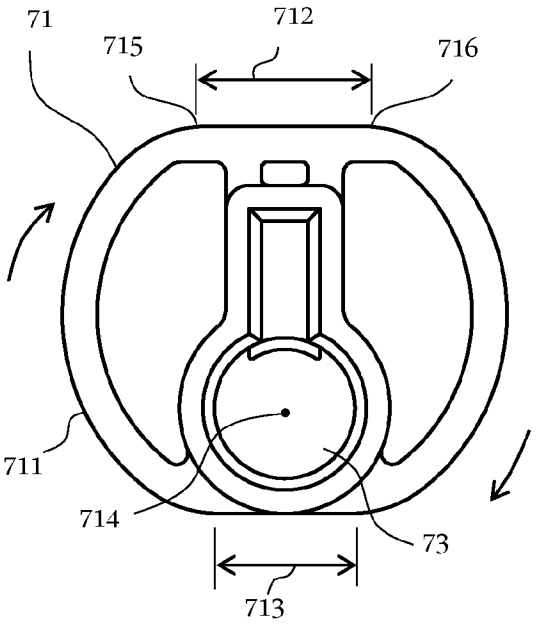
FIG. 5A is a front view of a first eccentric cam.
Figure 5B:
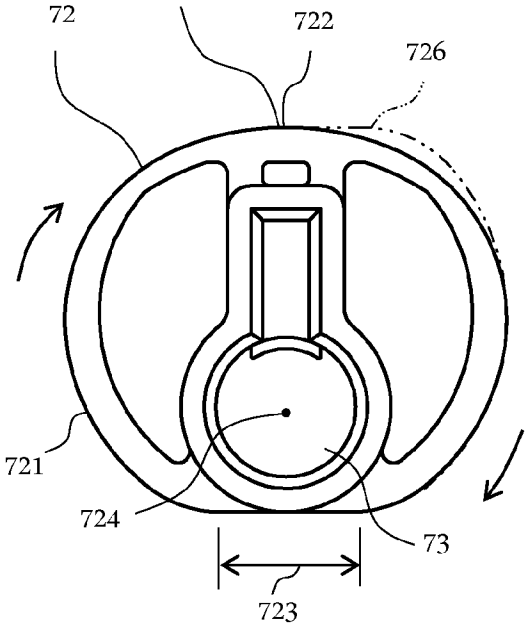
FIG. 5B is a front view of a second eccentric cam.
Figure 5C:
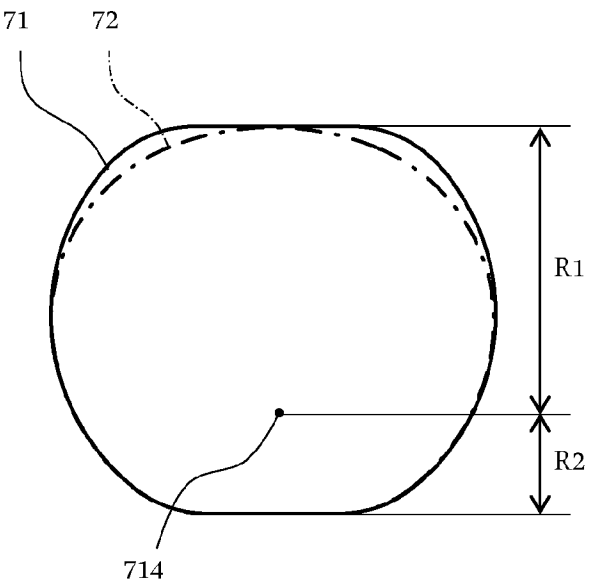
FIG. 5C is a drawing comparing the first eccentric cam with the second eccentric cam.

As shown in FIG. 5A, FIG. 5B and FIG. 5C, the first eccentric cam 71 has, at the peripheral portion 711 thereof, a press generating section 712 that causes the secondary transfer unit 40 to be disposed at the pressing position, and a separation generating section 713 that causes the secondary transfer unit 40 to be disposed at the separate position. The press generating section 712 is a flat surface, and the entire surface of the press generating section 712 is brought into contact with the flat surface of the secondary transfer frame 47 when the secondary transfer unit 40 is caused to be disposed at the pressing position. Again, the separation generating section 713 is also a flat surface, and the entire surface of the separation generating section 713 is brought into contact with the flat surface of the secondary transfer frame 47 when the secondary transfer unit 40 is caused to be disposed at the separate position. A radius in the middle of the press generating section 712 in a direction along the peripheral portion 711, that is to say a distance R1 from a center of rotation 714, is larger than a radius in the middle of the separation generating section 713, that is to say a distance R2 from the center of rotation 714.

Figure 6:
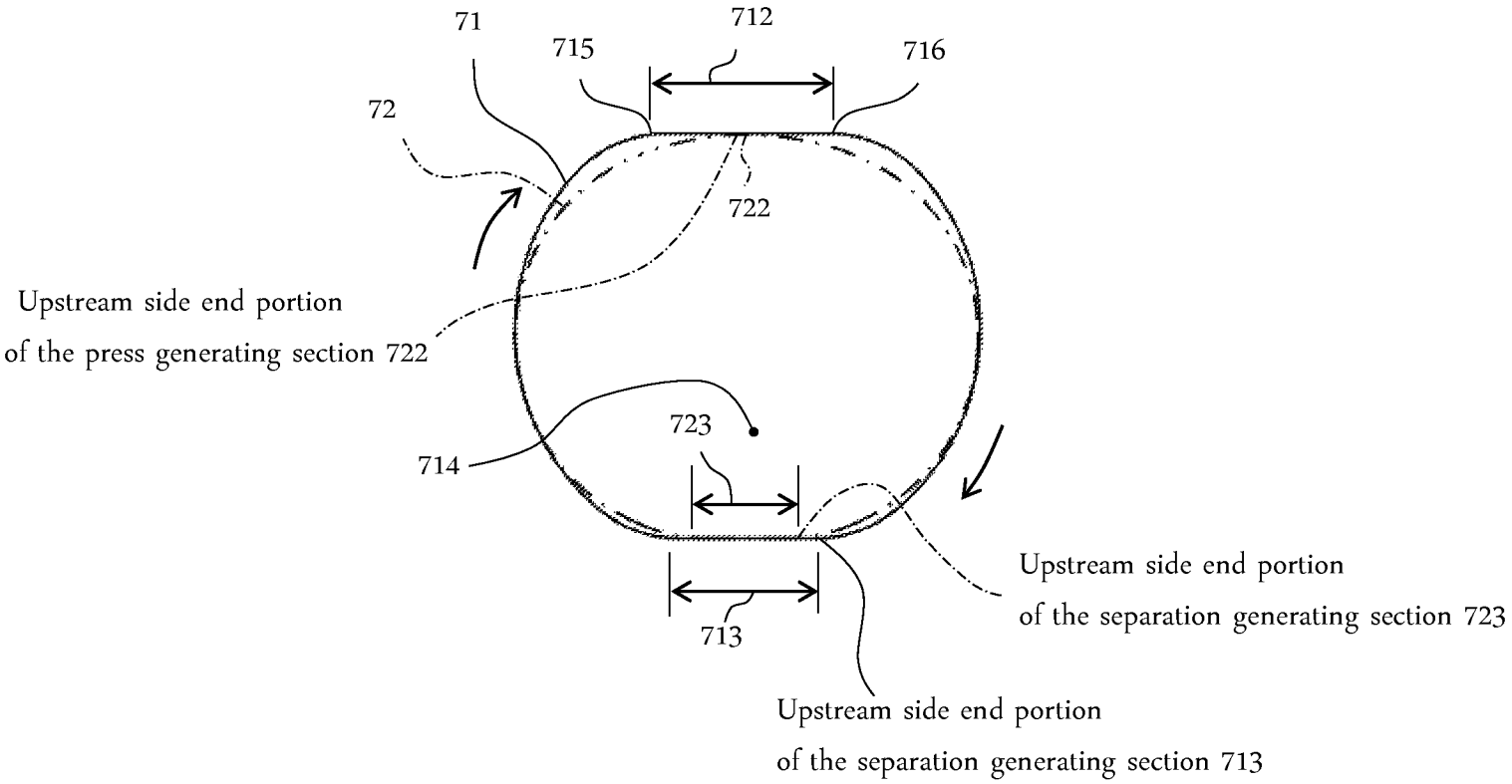
FIG. 6 is another drawing comparing another first eccentric cam with another second eccentric cam.

The second eccentric cam 72 has, at the peripheral portion 721 thereof, a press generating section 722 and a separation generating section 723. A length of the press generating section 722 in a direction along the peripheral portion 721 of the second eccentric cam 72 is shorter than a length of the press generating section 712 in the direction along the peripheral portion 711 of the first eccentric cam 71. In the embodiment, the press generating section 722 of the second eccentric cam 72 is part of the peripheral surface rather than a flat surface, so that the second eccentric cam 72 comes into contact with the secondary transfer frame 47 by a straight line having a direction perpendicular to a rotating direction of the shaft member 73 when the secondary transfer unit 40 is caused to be disposed at the pressing position (as shown in FIG. 6). The separation generating section 723 is a flat surface, and when it causes the secondary transfer unit 40 to be disposed at the separate position, the entire surface of the separation generating section 723 comes into contact with the flat surface of the secondary transfer frame 47. A length of the separation generating section 723 in the direction along the peripheral portion 721 of the second eccentric cam 72 is formed generally a same as a length of the separation generating section 713 in the direction along the peripheral portion 711 of the first eccentric cam 71; however, it may be shorter.

The radius in the middle of the press generating section 712 in the direction along the peripheral portion 711 of the first eccentric cam 71, that is to say the distance R1 from the center of rotation 714, and a radius in the middle of the press generating section 722 of the second eccentric cam 72, that is to say a distance R1 from a center of rotation 724 are the same. Also, the distance R2 from the center of rotation 714 of the separation generating section 713, and a distance R2 from the center of rotation 724 of the separation generating section 723 are the same. The distance R1 is longer than the distance R2.

With the first eccentric cam 71 and the second eccentric cam 72 rotating to an angle at which the press generating sections 712, 722 come into contact with the secondary transfer frame 47 together, the secondary transfer unit 40 is disposed at the pressing position. With the press generating section 712 of the first eccentric cam 71 and the press generating section 722 of the second eccentric cam 72 coming into contact with the secondary transfer frame 47 together, the secondary transfer unit 40 is pressed against the primary transfer belt 31 stably by both of the first eccentric cam 71 and the second eccentric cam 72. With the first eccentric cam 71 and the second eccentric cam 723 rotating to an angle at which the separation generating sections 713, 723 come into contact with the secondary transfer frame 47, the secondary transfer unit 40 is disposed at the separate position.

As described above, the first eccentric cam 71 and the second eccentric cam 72 are different in shape from each other in a plane orthogonal to a longitudinal direction of the shaft member 73. In other words, the length of the press generating section 722 in the direction along the peripheral portion 721 of the second eccentric cam 72 is shorter than the length of the press generating section 712 in the direction along the peripheral portion 711 of the first eccentric cam 71.

Additionally, as shown in FIG. 5C, when the first peripheral portion 711 of the first eccentric cam 71 is compared with the second peripheral portion 721 of the second eccentric cam 72 with regard to segments respectively in phase with each other, it follows that there is no segment in the entire first peripheral portion 711 of the first eccentric cam 71 that is smaller in radius than the second peripheral portion 721 of the second eccentric cam 72, and that at least a segment of the second peripheral portion 721 of the second eccentric cam 72 is smaller in radius than the first eccentric cam 71. As an example, of the peripheral portion 721 other than the press generating section 722 and the separation generating section 723 of the second eccentric cam 72, a segment that is nearer to the press generating section 722 than the separation generating section 723 is smaller in radius than the first eccentric cam 71.

With the configuration as stated above, because of their distinct difference in shape between each other even when either one is turned the other way around, the first eccentric cam 71 and the second eccentric cam 72 can be identified distinctively and easily by visual observation. Therefore, it is not likely that wrong attaching positions occur between the first eccentric cam 71 and the second eccentric cam 72.

The first eccentric cam 71 and the second eccentric cam 72 are disposed on the opposite side of the primary transfer belt 31 in relation to the second transfer frame 47, and the distance R1 is longer than the distance R2. As a result, a rotatory torque for the first eccentric cam 71 and the second eccentric cam 72 becomes larger in the state where the press generating sections 712, 722 are in contact with the secondary transfer frame 47 than in the state where the separation generating sections 713, 723 are in contact with the secondary transfer frame 47.

Further, the rotatory torque becomes particularly large at the time when a contact portion at which the peripheral portion 711 of the first eccentric cam 71 and the secondary transfer frame are in contact with each other passes through either end portion of the press generating section 712 in the direction along the peripheral portion 711 from the state in which the press generating section 712 of the first eccentric cam 71 is in surface contact with the flat surface of the secondary transfer frame 47. Accordingly, once disposed at the pressing position, the secondary transfer unit 40 is retained stably at the pressing position by the first eccentric cam 71.

On the other hand, because the length of the first press generating section 722 of the second eccentric cam 72 is shorter than that of the press generating section 712 of the first eccentric cam 71 in the directions along the peripheral portions 711, 721, a radius at least at either of the end portions of the press generating section 722 of the second eccentric cam 72 is smaller than a radius at the press generating section 712 of the first eccentric cam 71. Therefore, a load working on the second eccentric cam when the contact portion with the secondary transfer frame 47 passes through at least either of the end portions of the press generating section 712 of the first eccentric cam 71, 72 is reduced. In this manner, because a rotatory torque for the second eccentric cam 72 becomes smaller than that for the first eccentric cam 71 when the rotatory torque for the first eccentric cam 71 becomes particularly large, loads working on drive system members such as the shaft member 73, gears, an electromagnetic clutch and so forth are reduced.

Besides, in the embodiment, the first eccentric cam 71 and the second eccentric cam 72 are respectively configured with line symmetry in a plane orthogonal to the longitudinal direction of the shaft member 73. This eliminates the need to distinguish between front and back sides on each of the first eccentric cam 71 and the second eccentric cam 72, thereby increasing the installation workability more. Moreover, in this case, the radius at the upstream side end portion 715 of the press generating section 712 in the rotating direction of the shaft member 73 is a same as the radius at the downstream side end portion 716 thereof.

Here, in FIG. 5A through FIG. 5C, when the first eccentric cam 71 and the second eccentric cam 72 rotate in clockwise direction, the contact portions between the peripheral portions 711, 721 and the secondary transfer frame 47 respectively move toward counterclockwise direction.

When the contact portion between the peripheral portion 711 of the first eccentric cam 71 and the secondary transfer frame 47 moves from the separation generating section 713 toward the press generating section 712 through the downstream side end portion 716, the first eccentric cam 71 rotates with an approach from a state of a small rotatory torque; therefore, it is relatively easy for the contact portion to get through the downstream side end portion 716. On the other hand, when the contact portion moves from the press generating section 712 toward the separation generating section 713 through the upstream side end portion 715, the first eccentric cam 71 meets with the upstream side end portion 715 in a state of a large rotatory torque without any approach; therefore, the rotatory torque required to get through the upstream side end portion 715 becomes greatest.

Figure 7:
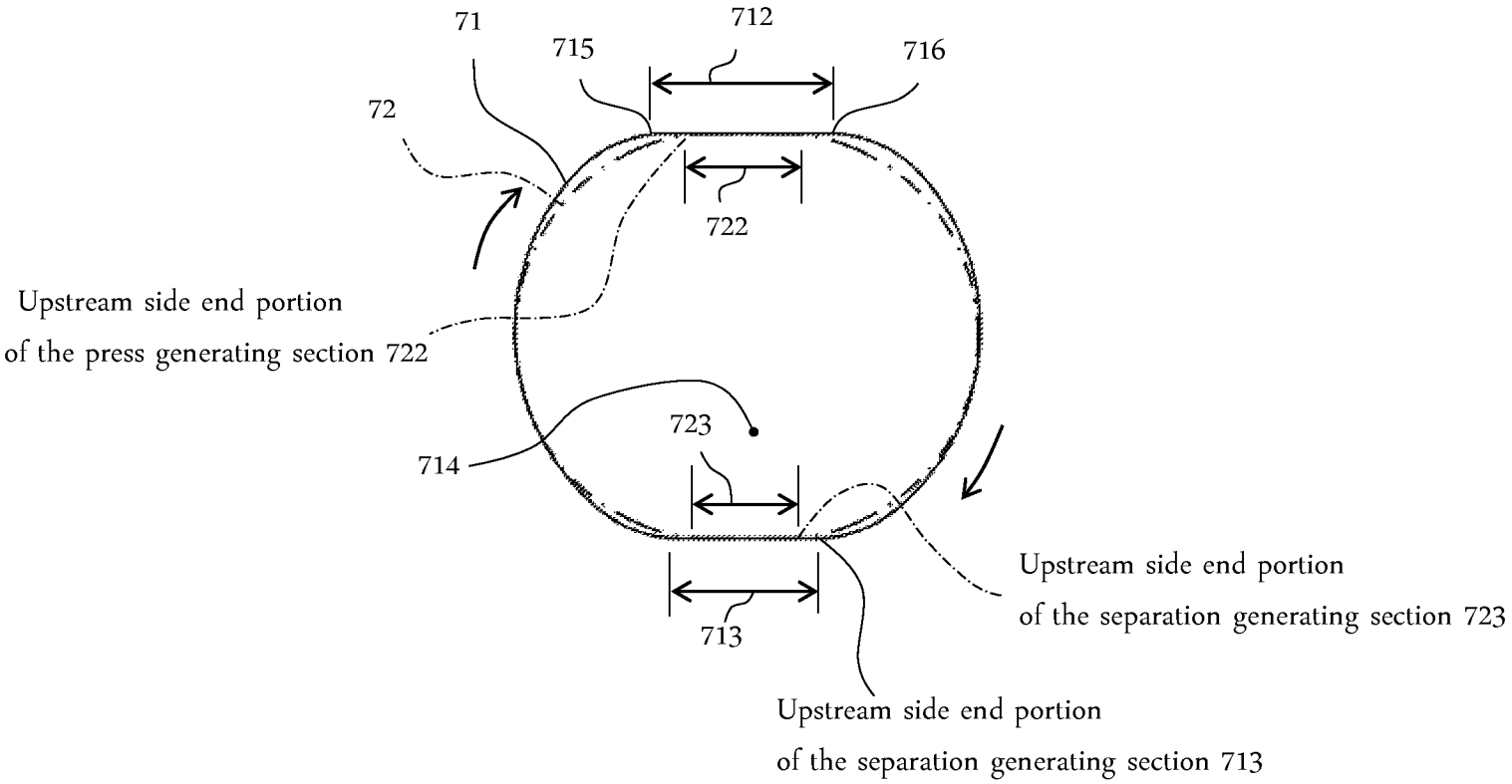
FIG. 7 is another drawing comparing another first eccentric cam with another second eccentric cam.

Thus, by employing a configuration such that an upstream side end portion of the press generating section 722 of the second eccentric cam 72 is located on a downstream side from the upstream side end portion 715 of the press generating section 712 of the first eccentric cam 71 in the rotating direction of the shaft member 73, the radius at the upstream side end portion of the press generating section 722 of the second eccentric cam 72 is made smaller than the radius at a portion of the press generating section 712 of the first eccentric cam 71 that is in phase with a portion of the second eccentric cam 72; and thereby the rotatory torque working on the second eccentric cam 72 when the maximum rotatory torque works on the first eccentric cam 71 is lowered. Therefore, a load collectively working on the shaft member 73 through the first eccentric cam 71 and the second eccentric cam 72 is reduced. Here, in the embodiment, the press generating section 722 of the second eccentric cam 72 is a straight line in the direction perpendicular to the rotating direction of the shaft member 73, and its width is considerably small (as shown in FIG. 7); so that the upstream side end portion, the middle portion and the downstream side end portion of the press generating section 722 generally mean the same portion each other.

The second eccentric cam 72 is not limited to being configured with line symmetry in the plane orthogonal to the longitudinal direction of the shaft member 73. A configuration should suffice provided that at least the upstream side end portion of the press generating section 722 is located on the downstream side from the upstream side end portion 715 of the press generating section 712 of the first eccentric cam 71 in the rotating direction of the shaft member 73. As shown by a two-dot chain line in FIG. 5B, the second eccentric cam 72 may also be configured in such a manner that the peripheral portion 721 between the press generating section 722 and the separation generating section 723 on the downstream side of the press generating section 722 in the rotating direction of the shaft member 73 becomes the same in radius as the first eccentric cam 71. In this case, a downstream side end portion 726 of the press generating section 722 of the second eccentric cam 72 is at the same position as the downstream side end portion 716 of the press generating section 712 of the first eccentric cam 71 in the rotating direction of the shaft member 73. Even with such a configuration, the rotatory torque working on the second eccentric cam 72 when the maximum rotatory torque works on the first eccentric cam 71 is lowered; thereby reducing the load working on the shaft member 73.

Additionally, when the first eccentric cam 71 and the second eccentric cam 72 are disposed on the same side as the primary transfer belt 31 in relation to the secondary transfer unit 40, a configuration is employed such that the separation generating section 713 of the first eccentric cam 71 is of a radius larger than that of the press generating section 712, and that the length of the separation generating section 723 of the second eccentric cam 72 becomes shorter than that of the separation generating section 712 of the first eccentric cam 71 along the directions of each of the peripheral portion 711 of the first eccentric cam 71 and the peripheral portion 721 of the second eccentric cam 72. Further, it is preferable to employ a configuration such that the upstream side end portion of the separation generating section 723 of the second eccentric cam 72 is located on the downstream side from the upstream side end portion of the separation generating section 713 of the first eccentric cam 71 in the rotating direction of the shaft member 73. Again with such a configuration, loads working on the drive system members such as the shaft member 73 and so forth can be reduced, and workability in the assembly task can be improved.

The above explanation of the embodiment is nothing more than illustrative in any respect, nor should be thought of as restrictive. Scope of the present invention is indicated by claims rather than the above embodiment. Further, it is intended that all changes that are equivalent to a claim in the sense and realm of the doctrine of equivalence be included within the scope of the present invention.

REFERENCE SIGNS LIST

10—Image forming apparatus
11, 12—Main body frame
20A through 20D—Image forming section
21A through 21D—Photoreceptor drum (image bearing member)
30—Primary transfer unit
31—Primary transfer belt
40—Secondary transfer unit
41—Secondary transfer belt
61—Motor (driving source)
71—First eccentric cam
711—Peripheral portion
712—Press generating section
713—Separation generating section
714—Center of rotation
715—Upstream side end portion
716—Downstream side end portion
72—Second eccentric cam
721—Peripheral portion
722—Press generating section
723—Separation generating section
724—Center of rotation

726—Downstream side end portion

73—Shaft member

The invention claimed is:

1. A displacement mechanism for a secondary transfer unit for causing the secondary transfer unit that transfers a developer image onto a paper sheet in a state of being in contact with pressure with a primary transfer belt bearing the developer image to be displaced between a pressing position and a separate position in relation to the primary transfer belt, the displacement mechanism comprising:

a first eccentric cam and a second eccentric cam that are in contact with either edge portion of the secondary transfer unit in width direction of the primary transfer belt and that cause the secondary transfer unit to be displaced between the pressing position and the separate position by rotating;

a shaft member that is rotatably supported by a main body frame of an image forming apparatus equipped with the secondary transfer unit and that supports the first eccentric cam and the second eccentric cam fixedly; and a driving source for rotating the shaft member, wherein the first eccentric cam is configured in such a manner that it has, in a first peripheral portion, a first press generating section causing the secondary transfer unit to be disposed at the pressing position and a first separation generating section causing the secondary transfer unit to be disposed at the separate position, and that every radius in the entire first peripheral portion is of magnitude not less than a radius at a segment of the second eccentric cam that is in phase with a segment of the first peripheral portion; and the second eccentric cam is configured in such a manner as to have, in a second peripheral portion, a second press generating section of which radius is a same as that of the first press generating section and a second separation generating section of which radius is a same as that of the first separation generating section, and that a radius in at least a segment of the second peripheral portion not including the second press generating section nor the second separation generating section is smaller than a radius at a segment of the first eccentric cam that is in phase with the segment of the second peripheral portion.

2. The displacement mechanism for a secondary transfer unit as claimed in claim 1, wherein the first press generating section is of a radius larger than that of the first separation generating section; and a length of the second press generating section is shorter than that of the first press generating section in directions along each of the first peripheral portion and the second peripheral portion.

3. The displacement mechanism for a secondary transfer unit as claimed in claim 2, wherein the second eccentric cam is disposed on the shaft member such that an upstream side end portion of the second press generating section is located toward a rotating direction of the shaft member compared to an upstream side end portion of the first press generating section of the first eccentric cam.

4. The displacement mechanism for a secondary transfer unit as claimed in claim 1, wherein the first separation generating section is of a radius larger than that of the first press generating section; and a length of the second separation generating section is shorter than that of the first separation generating section in directions along each of the first peripheral portion and the second peripheral portion.

5. The displacement mechanism for a secondary transfer unit as claimed in claim 4, wherein the second eccentric cam is disposed on the shaft member such that an upstream side end portion of the second separation generating section is located toward a rotating direction of the shaft member compared to an upstream side end portion of the first separation generating section of the first eccentric cam.

6. The displacement mechanism for a secondary transfer unit as claimed in claim 1, wherein the first and second eccentric cams are respectively configured with line symmetry in a plane orthogonal to a longitudinal direction of the shaft member.

7. The displacement mechanism for a secondary transfer unit as claimed in claim 1, wherein the first and second eccentric cams respectively rotate toward a predetermined direction.

* * * * *